US006904260B2

(12) United States Patent
Behnke et al.

(10) Patent No.: US 6,904,260 B2
(45) Date of Patent: Jun. 7, 2005

(54) FIXING APPARATUS AND FIXING METHOD FOR A PRINTER

(75) Inventors: Knut Behnke, Kiel (DE); Hans-Otto Krause, Eckernfoerde (DE); Frank-Michael Morgenweck, Molfsee (DE); Domingo Rohde, Kiel (DE); Lars Seimetz, Achterwehr (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/664,686

(22) Filed: Sep. 17, 2003

(65) Prior Publication Data

US 2004/0234308 A1 Nov. 25, 2004

(30) Foreign Application Priority Data

Oct. 4, 2002 (DE) ..... 102 46 394

(51) Int. Cl.[7] ..... G03G 21/00
(52) U.S. Cl. ..... 399/341; 399/92
(58) Field of Search ..... 399/341, 320, 399/92, 406; 165/214; 55/294; 239/132, 132.2

(56) References Cited

U.S. PATENT DOCUMENTS 5,235,393 A * 8/1993 Merle ..... 399/341
5,404,934 A * 4/1995 Carlson et al. ..... 165/214
6,094,560 A * 7/2000 Thomas ..... 399/341
6,109,184 A 8/2000 Wech
6,226,474 B1 * 5/2001 Kowalski et al. ..... 399/92
6,272,311 B1 8/2001 Baughman et al.
6,401,358 B1 6/2002 Bär et al.
6,580,884 B2 * 6/2003 Kuwabara ..... 399/92
2002/0186986 A1 * 12/2002 Makihira ..... 399/92

FOREIGN PATENT DOCUMENTS

DE 32 04 140 A1 8/1983 ..... B65G/7/06
DE 37 27 166 A1 2/1989 ..... B25H/1/00
DE G 93 10 028.0 12/1993 ..... B41F/23/04
DE 198 02 739 A1 7/1999 ..... B41F/23/04
DE 198 07 643 C2 1/2000 ..... B41F/23/04

* cited by examiner

*Primary Examiner*—Arthur T. Grimley
*Assistant Examiner*—Peter Lee
(74) *Attorney, Agent, or Firm*—Lawrence P. Kessler

(57) ABSTRACT

Fixing toner on a print substrate in printers a cooling device is provided for cooling the sheet with a coolant after fixing the toner to the sheet, the cooling device having a flow passage for discharging the coolant onto the sheet the flow passage converging to increase coolant velocity.

7 Claims, 3 Drawing Sheets

FIXING APPARATUS AND FIXING METHOD FOR A PRINTER

FIELD OF THE INVENTION

The invention relates to a fixing apparatus and method having a cooling device for blowing coolant on a fixed toner image.

BACKGROUND OF THE INVENTION

During printing, after controlled deposition of a toner material to the print substrate, the toner is fixed to the print substrate. Various methods of fixing toner material are known. According to a conventional method, a heated fixing roll is rolled over the print substrate with the deposited toner thereon, with a predetermined pressure. In this manner, the toner adheres reliably to the substrate, and the toner particles are strongly attached to the print substrate or to the image support. In another method, the print substrate with the deposited toner is heated with energy radiation, and the toner is reliably attached to the print substrate under the effect of energy radiation only, without any mechanical action. When the print substrate and the toner are irradiated, e.g., with microwaves, with subsequent printing on the print substrate, the image on the first print side, which has been formed by the toner on the print substrate, may be damaged by mechanical action because the toner on the first print side is in the low-viscous condition. The printed image is, therefore, sensitive to a mechanical action during and after the fixing of the toner to the print substrate for some time, for example, because of contact with a transport belt, which feeds the printed matter through the printer.

SUMMARY OF THE INVENTION

It is an object of the invention to assure reliable attachment of the toner to the print substrate and to preserve fully the resulting printed image on the substrate. A fixing apparatus is provided for fixing the toner to a print substrate (sheet) in a printer, having a cooling device for cooling the sheet with a coolant after fixing the toner to the sheet, the cooling device having a cooling passage for the flow of the coolant to the sheet. The cooling device imparts swirling to the coolant and supplies it to the sheet.

In one embodiment of the invention, the surfaces of the flow passage of the cooling device, for the coolant, are convergent in order to increase the coolant velocity. The cooling effect on the sheet is enhanced with a higher coolant velocity. In another embodiment of the invention, a compressed air device for sheet touchless transport has ports of different sizes, whereby different force is applied to the sheet depending on the port size. In this manner, the force acting upon the sheet in different applications can be adjusted. In addition, the ports of the cooling device can be provided with ports through which the coolant flows and with dampers for controlled partial uncovering and for covering of the ports. With this embodiment, intensity of sheet cooling by the cooling device can be controlled and can be adjusted for different kinds of sheets.

The cooling device can be provided with a swirler for producing swirled coolant flows. In this manner, the cooling action upon the sheet surface is substantially enhanced because of improved heat removal from the sheet with the toner by the coolant. In another embodiment of the invention, the coolant partly contains finely atomized water, which is accumulated in the fixing device during fixing, and the coolant advantageously contains the water formed as a result of fixing and also added water. Because of the fine atomizing of water, a high cooling action upon the sheet with the toner is assured.

Another improvement of the cooling action is achieved by providing the cooling device with a device for producing compressed air. In one embodiment of the invention, the flow passage is made of a flexible material, and the shape of the flow passage is variable. By varying the shape of the flow passage, the coolant flow intensity can be controlled in a simple manner. In another embodiment of the invention, the sheet temperature is measured, and the measurement result is used to control the cooling device. With the known sheet temperature, the cooling of the sheet with the toner can be controlled so that cooling can be adjusted for each individual sheet. In a further embodiment, the intensity of the cooling device is controlled as a function of the sheet type. Different kinds of sheets require different cooling.

BRIEF DESCRIPTION OF THE DRAWINGS

The invention will now be described with reference to the accompanying drawings illustrating the embodiments of the invention.

DETAILED DESCRIPTION OF THE INVENTION

Figure 1:
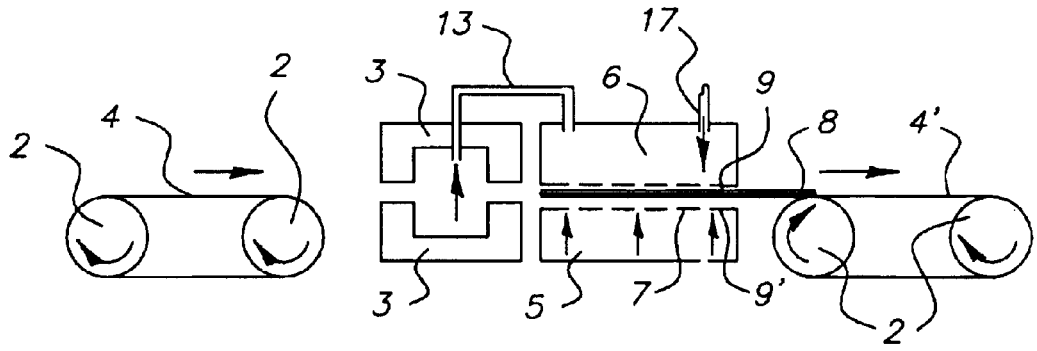
FIG. 1 is a schematic side elevation view of one embodiment of the invention with transport belts, a microwave applicator, a compressed air device, and a cooling device.

FIG. 1 shows a schematic side elevation view of an embodiment of the invention, which is used in a printer. The drawing shows a part of a transport belt 4 in the left hand side of FIG. 1, which extends around rollers 2 and which is driven by them. In this example, the transport belt 4 moves a print substrate or sheet 8 through the printer. The sheet 8 is coated with one or with a plurality of toner layers so that a printed image is formed on the sheet 8. The toner layers are deposited at the previous steps of printing, and these steps are not illustrated here.

After application of the toner layers or toner, they are normally fixed to the sheet 8. For that purpose, the sheet 8 is fed by the transport belt 4 in the direction toward a microwave applicator 3, which is part of the microwave device, in which the sheet 8 with the toner is exposed to a strong microwave field. In forming a duplex print (a toner image on a side of a sheet), the first print side of the sheet 8 may already be provided with the toner, which has been already fixed. The sheet 8 with the toner is heated by the microwave field in the microwave applicator 3, and the toner is reliably attached to the sheet 8 and fixed.

After leaving the microwave applicator 3, the toner is fixed to the sheet, but the toner has not yet hardened. At this point, the toner is still prone to smearing over the sheet 8, especially if the toner on the first print side of the sheet 8, which has already been fixed, is heated, resulting in smearing. The first print side is especially prone to smearing of the toner because the toner is on the underside of the sheet 8 that rests of the transport belts 4, 4'.

Downstream from the microwave applicator 3 in the direction of sheet transport, the sheet 8 is fed to a compressed air device 5. The compressed air device 5 is provided below the sheet transport path, and it builds up air pressure directed upwards, toward the sheet 8, whereby the force of the compressed air device 5 acts upon the sheet 8 and carries it. The compressed air device 5 has a closed housing, with the exception of the top side, which has ports 9' for directing compressed air. The top side of the compressed air device 5 is made, e.g., as a perforated plate 7. The perforated plate 7 is shown schematically with dotted lines in FIG. 1.

A cooling device 6 is positioned above the transport path of the sheet 8 and over the compressed air device 5. The cooling device 6 supplies a coolant, which is fed from the cooling device 6 to the surface of the sheet 8. Water, helium, or hydrogen can be used as a coolant. The coolant is supplied from a flow passage of the cooling device 6 to a desired place, e.g., directly after a fan of the cooling device 6. As shown in the embodiment of FIG. 1, the coolant is directed via a connecting line 13 between the microwave applicator, in which water forms by evaporation, and the cooling device 6. The coolant is also fed to the cooling device via a supply line 17 so as to assure replenishing with a fresh coolant through the supply line 17.

The heat energy is removed from the surface of the sheet 8 and is taken off by the coolant. The cooling action of the cooling device 6 is controlled in such a manner that the glass transition temperature of the toner is reached. Depending on the toner material used, the sheet 8 with the toner is cooled to 20° C.–60° C. There is no risk that the toner on the first print side will be smeared by another object and that the printed image on the first print side of the sheet will be damaged during the fixing of the other print side following contact with another object. Subsequently, the sheet 8 is picked up, after the compressed air device 5 and the cooling device 6, by another endless transport belt 4' and is moved by the belt. The transport belt 4' extends around rollers 2, which drive the belt in the direction shown in the drawing. There is no risk on the transport belt 4' that the printed image on the first print side of the sheet 8 can be damaged.

Figure 2:
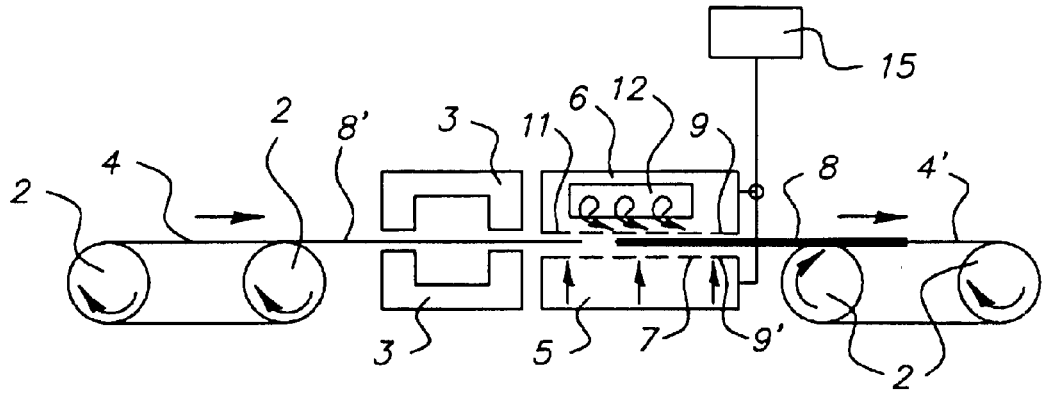
FIG. 2 is a schematic side elevation view similar to FIG. 1, with two different sheet types, which are cooled with different intensity.

FIG. 2 shows an embodiment of the invention in which the sheet 8 having one type of print substrate and a sheet 8' having another type of print substrate are transported. Different types of print substrates occur more specifically with digital printing. The two types of print substrates differ in thickness, so the sheet 8 has a larger thickness than the sheet 8'. A control device 15, which is connected to the compressed air device 5 and the cooling device 6, sends data on the current print substrate to the cooling device 6. If there is the thicker sheet 8, more coolant is fed from the cooling device 6 to the sheet 8 than to the sheet 8'. This position is illustrated in FIG. 2 by showing larger ports 9 with the dotted lines on the bottom side of the cooling device 6, so larger ports 9 are shown over the thicker sheet 8 than over the thinner sheet 8'.

Different size of the ports 9 is obtained, for example, by controlled dampers 11, which are controlled based on the data from the control device 15 and which cover the ports 9 to a greater or lesser extent. In the left hand side of the cooling device 6 in FIG. 2, the dampers 11 cover the ports 9 to a greater extent than on the right hand side. Should the print substrate, e.g., the sheet 8', on which the toner was fixed in the fixing device be thinner than the previous thick sheet 8, the control device 15 will send a signal to the cooling device 6. As a result, the dampers 11 will automatically partly cover the ports 9 to such an extent as to reduce the size of the ports 9 of the cooling device appropriately, and, as a result, the cooling action upon the sheet 8' will be adjusted according to the sheet thickness of the sheet 8'.

Figure 3A:
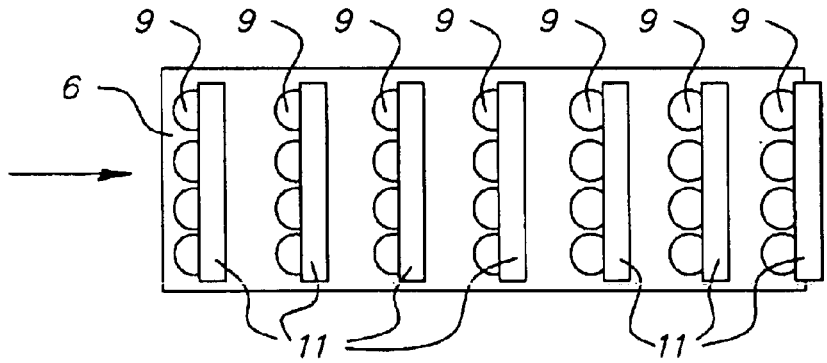
FIG. 3*a* is a bottom view of the cooling device with openings and controlled dampers for uncovering and covering the ports, with the dampers covering the ports differently.
Figure 3B:
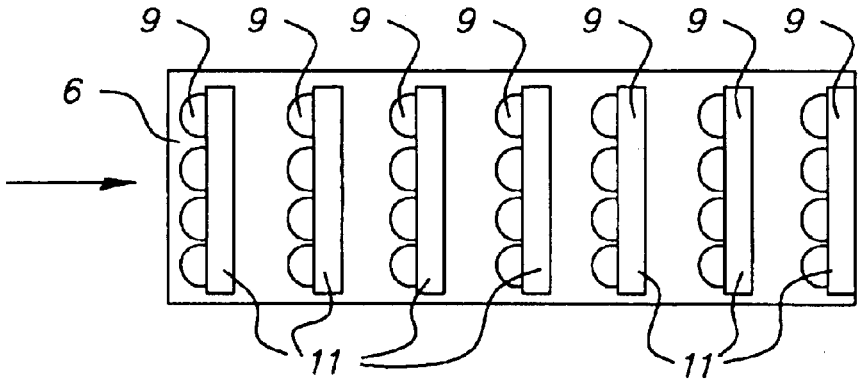
FIG. 3*b* is a bottom view similar to that shown in FIG. 3*a*, wherein the dampers cover the ports identically.
Figure 3C:
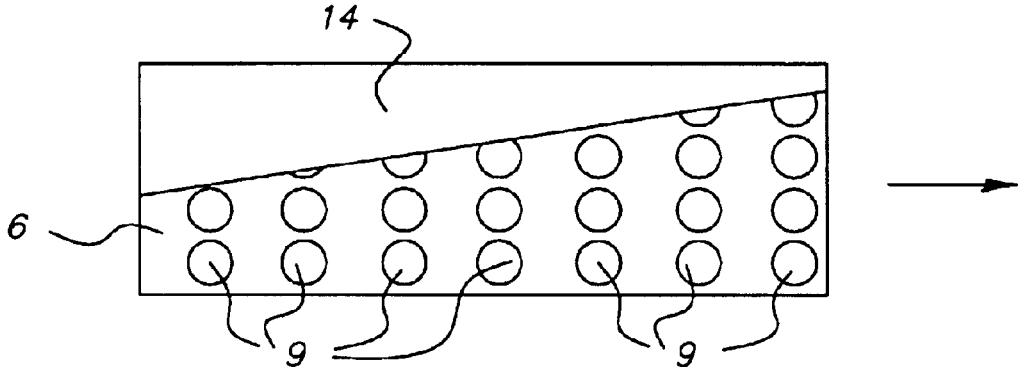
FIG. 3*c* is a bottom view of the cooling device with ports and a controlled shutter for opening and covering the ports, with the shutter covering the ports differently.

This mode of operation is illustrated schematically in FIGS. 3*a* and 3*b*, which show a bottom view of the cooling device 6 with the ports 9 covered with the dampers 11 on the left hand side to a greater extent and covered to a smaller extent with the dampers 11 on the right hand side. As an alternative to the dampers 11, a rotatable shutter 14 can be used as shown in FIG. 3*c*, which covers to a greater or lesser extent the ports 9 along the bottom side of the cooling device 6 or is rotatable over the inlet passage or outlet passage of a cross-flow air blower 19 (see FIG. 4*a*). The shutter 14 is mounted in a shutter drum in this case. The assumption is that when the coolant enters the cross-flow air blower 19, there is no mass balance axially of the fan of the cross-flow air blower 19, and the coolant will be accelerated at this point when it enters the fan rotor of the cross-flow air blower 19. Otherwise, an undesired constant flow volume of coolant would enter the cooling device 6, which impairs the effect described with reference to FIGS. 4*a* through 4*d*. It is then required that the coolant flow velocity in the flow passage 18 be high.

Regarding FIGS. 2, 3*a*, and 3*b*, a lower force acts upon the sheet 8' compared to the force acting upon the thicker sheet 8. The lower force in the left hand part of FIG. 2 is balanced by sending a signal from the control device 15 of the printer to the compressed air device 5, according to which that the compressed air acting upon the sheet 8' from below is changed in such a manner as to establish a force equilibrium at the sheet 8'. This means that the sheet 8', in spite of the force acting upon the sheet 8' from above that has been changed, continues to be carried forward uniformly and without deviations from the path. The position of the sheet 8' is controlled by controlling the compressed air device 5.

In addition, the cooling device 6 has a swirler 12, which swirls the coolant and enhances the cooling performance. Because of strong swirling of the coolant, the heat barrier layers on the surface of the sheet 8, 8' are broken through, and the heat removal from the surface of the sheet 8, 8' to the coolant is enhanced. In order to achieve swirling, the swirler 12 has a turbulizer in the cooling device 6, to which the coolant is fed.

FIG. 3*a* shows a bottom view of the cooling device 6 with ports 9 and controlled dampers 11 for uncovering and covering the ports 9. The transport direction of the sheet 8, 8' is from left to right as shown in FIGS. 1 and 2. The dampers 11, are controlled by the control device 15, depending on the desired cooling action upon the sheet 8, 8'. In this case, the dampers 11 cover the ports 9 in the left hand area of the cooling device 6 more than they do in the right hand area. This means that more coolant flows out in the right hand area than in the left hand area, so the right hand area will be cooled stronger than the left hand area. This corresponds to FIG. 2, where there is currently the thicker sheet 8 in the right hand area, which requires much cooling, and the thinner sheet 8' in the left hand area, which requires less cooling. When the thicker sheet 8 is moved out of the cooling device 6, and the thinner sheet 8' is not only in the left hand area, but also in the right hand area, the dampers 11 are adjusted by the control device 15, and the dampers 11 in the right hand area are moved further forward over the ports 9 to cover more surface area of the ports 9 than in FIG. 3*a*, whereby the ports 9 in the right hand area are covered to the same extent as the ports 9 in the left hand area. This position is shown in FIG. 3*b*, with the same cooling over the entire length of the cooling device 6.

Figure 3D:
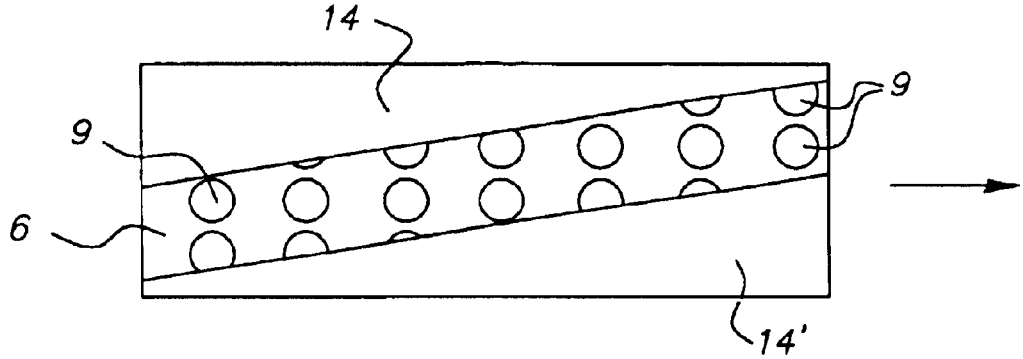
FIG. 3*d* is a bottom view similar to that shown in FIG. 3*c* with another shutter added and with the ports covered identically.

FIG. 3*c* shows a bottom view of the cooling device 6 with the ports 9 and the controlled shutter 14 for uncovering and covering the ports 9 similarly to what is shown in FIGS. 3*a* and 3*b*. The shutter 14 is moved over the ports 9 to the extent such as to assure non-uniform cooling, with lower cooling in the left hand area and higher cooling in the right hand area, similarly to FIG. 3*a*, with more coolant flowing out the ports 9 in the right hand area than in the left hand area. FIG. 3*d* shows the case in which the uniform cooling is assured similar to what is shown in FIG. 3*b*. In this case, the thinner sheet 8' is under the cooling device 6, and the thicker sheet 8 is carried forward further and is removed from the cooling device 6.

Figure 4A:
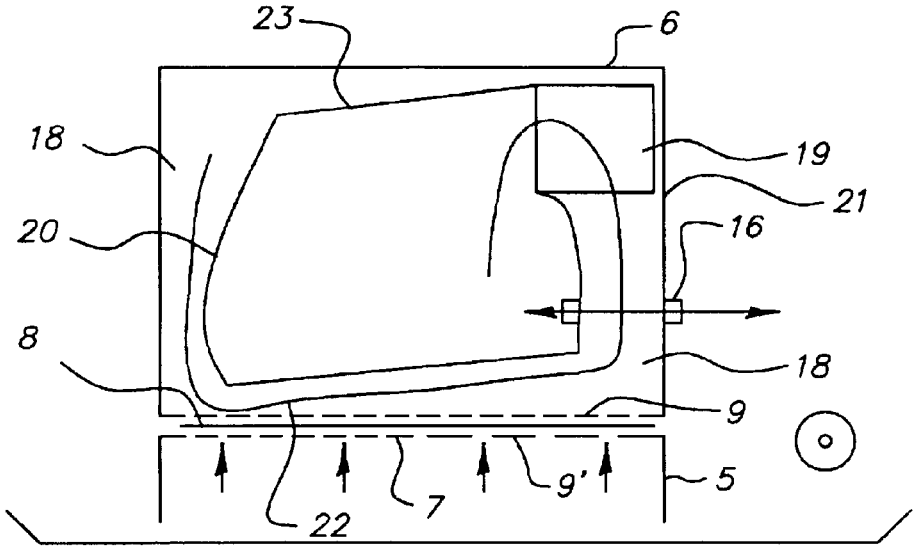
FIG. 4*a* is a schematic front elevation view of a cooling device having a specially arranged flow passage and a compressed air device.
Figure 4B:
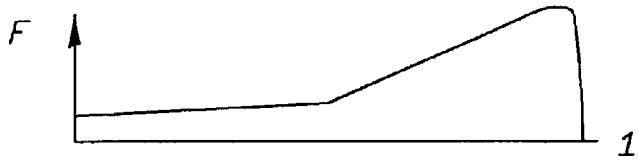
FIG. 4*b* shows the force acting upon the sheet versus the sheet width in the direction perpendicular to the sheet transport direction.

FIG. 4*a* shows a schematic side elevation view of the cooling device 6 for an embodiment of the invention illustrating the concept where it extends in the transversal direction with respect to the transport direction of the sheet 8, 8'. In this embodiment, the cooling device 6 has a cross-flow air blower 19, which takes in air and discharges it in the direction shown by arrow into the flow passage 18. The flow passage 18, is defined by, an inner wall 20, an outer wall 21, a bottom wall 22, and an upper wall 23. The flow passage 18 has an approximately constant diameter on the right hand side of the cooling device 6. In the bottom area, under the bottom wall 22, the flow passage 18 narrows, and the diameter of the flow passage 18 decreases respectively. The coolant flows in the right hand area approximately at right angles to the sheet 8, 8', and in the left hand area, the sheets 8, 8' will be exposed to the parallel flow action to the increasing extent, and for this reason, the force action on the sheet 8, 8' is stronger in the right hand area than it is in the left hand area. This means that the force action on the sheet 8, 8' from of the coolant below the bottom wall 22 is higher in the right hand area than in the left hand area in FIG. 4*a*.

This non-uniform force distribution on the surface of the sheet 8, 8' is leveled out by providing the ports 9' of the perforated plate 7 in the compressed air device 5, which have different sizes in the direction at right angles with respect to the transport direction of the sheet 8, 8'. With the different size of the ports 9', different quantities of compressed air flow upwards to the underside of the sheet 8, 8'. As a result, the force from the compressed air device 5 acting on the underside of the sheets 8, 8' balances the force acting on the upper side of the sheet 8, 8' from the cooling device 6, so as to assure the balance of forces over the width of the sheet 8, 8' at right angles with respect to the transport direction.

Figure 4C:
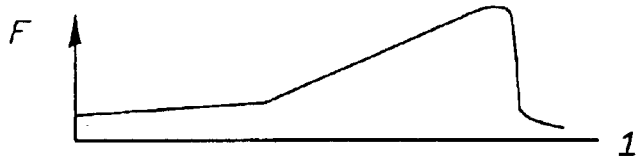
FIG. 4*c* shows the force acting upon the sheet versus the sheet width in the direction perpendicular to the sheet transport direction after adjustment of the flow passage.
Figure 4D:
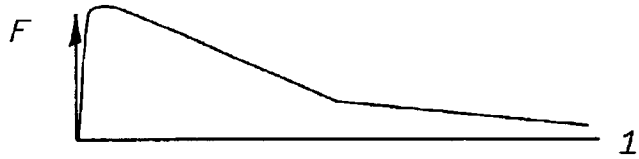
FIG. 4*d* shows the force acting upon the sheet versus the sheet width in the direction perpendicular to the sheet transport direction when the flow passage is reversed.

An actuator fork 16 is provided on one side of the cooling device 6, and is mounted on the side walls of the flow passage 18. The flow passage 18 may be formed of a flexible material. By moving the actuator fork 16, the flexible walls of the flow passage 18 are moved, and the coolant flow is controlled transversally of the sheet 8, transport direction. The movement of the actuator fork 16 acts on the relationship of the force versus width I of the cooling device 6 at right angles to the transport direction of the sheet 8, 8' as shown FIG. 4*c*. In FIG. 4*c*, the curve is offset to the left compared to FIG. 4*b* when the flow passage 18 moves. The force F acting on the sheet 8 increases greatly even with a smaller width I in comparison with FIG. 4*b*, and, as can be seen in FIG. 4*c*, the maximum of the force F is achieved with a smaller value of the width I. The force distribution on the sheet 8, from the force action of the cooling device 6, changes following the movement of the actuator fork 16.

In one embodiment of the invention, the cooling action through the cooling device 6 is enhanced by establishing a closed-loop coolant circuit, with which the coolant exchange takes place only within the space between two sheets 8, 8' moving one after the other. This embodiment is especially preferred when air is used as the coolant because air has bad heat conductivity, and for this reason it takes less energy from the sheet 8, 8', and the air in this embodiment circulates repeatedly in the closed-loop coolant circuit, thus assuring the required cooling action.

In spite of low heating of the air as a coolant, the air is heated during a long time of operation of the printer. This heating of the air, which results in a lower cooling action, can be counteracted, by establishing controlled replenishing of air. An inlet passage and an outlet passage can be provided in the cooling device 6 with an air intake valve and an air outlet valve to assure addition and supply of fresh air during the cooling cycle. With the narrow configuration, the cooling devices 6 can be combined in order to assure a wide cooling area for the sheets 8, 8'.

The cooling action can be further enhanced, by providing a plurality of cooling devices 6 in different directions. In this case, the sheets 8, 8' could be blown with the coolant under the first cooling device 6 from left to right and under the adjacent second cooling device in the opposite direction, i.e., with the flow passage 18 working from left to right. In this case, the force vs. width I along the cooling device 6 is represented by a chart in FIG. 4*d*. In this manner, coolant exchange at the border between the adjacent cooling devices 6 is eliminated whereas, to a disadvantage, with normally equalized coolant flow, the coolant would be drawn from the adjacent cooling device. Further, at least two cooling devices 6 can be placed one behind the other in such a manner as to compensate for non-uniformity of blowing through each of the cooling devices 6. It can be clearly seen that there is a non-uniform blowing with the coolant in FIG. 4*a*, wherein the stronger cooling action obtains in the area close to the cross-flow air blower 19 on the surface of the sheet 8, 8' than in the remote areas. This effect is balanced out by turning the adjacent cooling devices 6 at 180° with respect to each other so as to direct one flow from right to left and the other flow from left to right to obtain the charts shown in FIGS. 4*b* and 4*d*. Another possibility is to control the output of the cooling device 6 by controlling the speed of the fan in each cooling device 6. The cooling capacity can thus be adjusted for each specific application. To further enhance the cooling action, a plurality of cooling devices 6 in another embodiment can be placed on either side of the transport path at the same height with respect to the transport path or above and below the transport path of the sheet 8, 8'.

In a further development of the invention, the automatic control is established as follows. The coolant temperature is measured at the outlet of the coolant from the sheet 8, 8', for which purpose sensors such as thermo-elements are provided. Alternatively, the surface temperature of the sheet 8, 8' downstream from the cooling device 6 is measured by infrared measurement. The measured temperatures of the coolant or sheet 8, 8' are sent to the control device 15, in which the temperatures are compared to the temperature set points. When the measured temperature deviates from the temperature set point, the cooling device 6 is adjusted by the control device 15. The control device 15 in this case can, e.g., adjust the fan speed of the cross-flow air blower 19. In this manner, by providing the continuous temperature measurement and its comparison with temperature set points, automatic control is established. The compressed air device 5 is controlled by commands from the control device 15 in an appropriate manner so that with a higher force action on the sheet 8, 8' from above under the action of the cooling device 6, the amount of compressed air from the compressed air device is increased, and vice versa.

The larger the temperatures difference between the cold coolant and the hot sheet 8, 8', the better the cooling action. For this reason, the intake coolant is pre-cooled. A Peltier element can be incorporated the cooling device 6 for this purpose, which provides a higher temperature differential because of the Peltier effect. The cold side of the Peltier element can be incorporated in the flow passage in such a manner that the heated coolant flows along it, whereby the circulating coolant temperature in the cooling circuit decreases to a greater extent. Furthermore, a combined use of special radiator zones can be provided, which, apart from increasing the surface area, assure better heat transfer functioning like the swirler 12. More specifically, in the event that microwave resonators such TE101 Type are used, microwave irradiation through the space between the upper and lower applicator cups of the microwave applicator 3 is reduced by using so-called Choke Structures, which reflect the microwave radiation. This eliminates the losses in the microwave applicator 3.

Figure 5A:
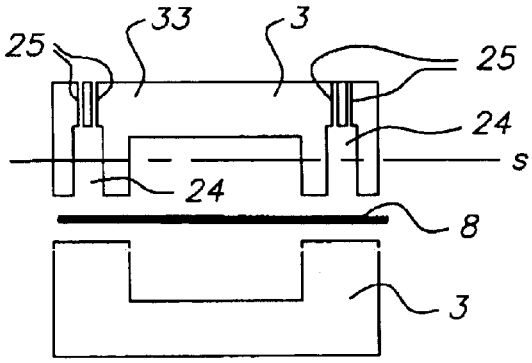
FIG. 5*a* is a schematic side elevation view of a microwave applicator having coolant passages for supplying coolant flows to the sheet in an alternate embodiment of the invention.
Figure 5B:
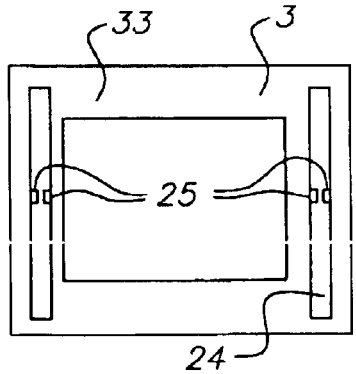
FIG. 5*b* is a schematic bottom view taken along line s of the microwave applicator shown in FIG. 5*a*.

The Choke Structures are built in a groove 24 surrounding the microwave applicator 3 in the rear end face of the walls of the microwave applicator 3 as shown in FIGS. 5*a* and 5*b*. The Choke Structures are functionally expandable through appropriate holes in a cover plate 33 of the microwave applicator 3 and are connected to coolant passages 25 as shown in FIGS. 5*a* and 5*b*, whereby the sheet 8, 8' is cooled through the cover plate 33 of the microwave applicator 3. In this manner, the coolant is fed in an appropriate way through the coolant passages 25 through the cover plate 33 of the microwave applicator 3 and the groove 24 to the sheet 8, 8', which is fed through the microwave applicator 3 and which are exposed to the microwaves in the applicator. The cooling device 6 is provided at the microwave applicator 3 for this purpose. A part of the coolant that passes through the coolant passages 25 in the microwave applicator 3 is taken in through the coolant passages 25 of the Choke Structures from the microwave applicator 3.

FIG. 5*b* shows a schematic bottom view of the microwave applicator 3 of FIG. 5*a* to illustrate the design of the microwave applicator 3. It shows the view of the cover plate 33 of the microwave applicator 3 taken along lines. The coolant passages 25, through which the coolant flows to the sheet 8, 8', are shown as rectangles that can be seen from bottom.

The invention has been described in detail with particular reference to certain preferred embodiments thereof, but it will be understood that variations and modification can be effected within the spirit and scope of the invention.

PARTS LIST

2 Rollers
3 Microwave applicator
4 Transport belt
4' Transport belt
5 Compressed air device
6 Cooling device
7 Perforated plate
8, 8' Sheets
9, 9' Ports
11 Damper
12 Swirler
13 Connecting line
14 Shutter
15 Control device
16 Actuator fork
17 Supply line
18 Flow passage
19 Cross-flow air blower
20 Inner wall
21 Outer wall
22 Bottom wall
23 Upper wall
24 Groove
33 Cover plate

What is claimed is:

1. A fixing apparatus for fixing the toner to a sheet (8, 8') in a printer said fixing apparatus comprising: a cooling device (6) for cooling the sheet (8, 8') with a coolant after fixing the toner to the sheet (8, 8'), the cooling device (6) including a flow passage (18) for blowing the coolant to the sheet (8, 8') said flow passage (18) converging to increase the velocity of the coolant, said flow passage (18) being made of a flexible material, and the shape of said flow passage (18) being changeable.

2. The fixing apparatus of claim 1, wherein said cooling device (6) includes a swirler (12) to produce a swirled flow of the coolant.

3. The fixing apparatus of claim 1, wherein said cooling device (6) has ports (9) for the passage of the coolant and at least one damper (11) for controlled uncovering and covering of the ports (9).

4. The fixing apparatus of claim 1, wherein said cooling device (6) has a device (5) for producing compressed air.

5. The fixing apparatus of claim 1, wherein said coolant partly contains finely atomized water, which is accumulated in the fixing device during fixing.

6. The fixing apparatus of claim 4, further including compressed air device (5) under the sheet (8, 8') for touchless transport of the sheet (8, 8').

7. The fixing apparatus of claim 6, wherein said compressed air device (5) for touchless transport of the sheet (8, 8') has ports (9') of different sizes, with different force action of the sheet (8, 8') being applied depending on the port size.

* * * * *